US011541659B2

(12) United States Patent
Choy et al.

(10) Patent No.: US 11,541,659 B2
(45) Date of Patent: Jan. 3, 2023

(54) MOLDED PRINTHEAD

(71) Applicant: Hewlett-Packard Development Company, L.P., Spring, TX (US)

(72) Inventors: Silam J Choy, Corvallis, OR (US); Michael W Cumbie, Corvallis, OR (US); Devin Alexander Mourey, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/991,524

(22) Filed: Aug. 12, 2020

(65) Prior Publication Data

US 2020/0369031 A1 Nov. 26, 2020

Related U.S. Application Data

(60) Continuation of application No. 16/025,222, filed on Jul. 2, 2018, now Pat. No. 10,836,169, which is a (Continued)

(30) Foreign Application Priority Data

Feb. 28, 2013 (WO) ..... PCT/US2013/028216
Jun. 17, 2013 (WO) ..... PCT/US2013/046065

(51) Int. Cl.
*B41J 2/16* (2006.01)
*B41J 2/14* (2006.01)
(Continued)

(52) U.S. Cl.
CPC ..... *B41J 2/1637* (2013.01); *B41J 2/14* (2013.01); *B41J 2/1433* (2013.01);
(Continued)

(58) Field of Classification Search
CPC ..... B41J 2/1637; B41J 2/14; B41J 2/14072; B41J 2/14145; B41J 2/1433; B41J 2/155; B41J 2/1601
See application file for complete search history.

(56) References Cited

U.S. PATENT DOCUMENTS 4,224,627 A 9/1980 Powell et al.
4,460,537 A 7/1984 Heinle
(Continued)

FOREIGN PATENT DOCUMENTS

CN 1175506 3/1998
CN 1197732 11/1998
(Continued)

OTHER PUBLICATIONS

International Search Report & Written Opinion received for PCT Application No. PCT/US2013/074925, dated Mar. 20, 2014, 14 pages.
(Continued)

*Primary Examiner* — Jason S Uhlenhake
(74) *Attorney, Agent, or Firm* — Foley & Lardner LLP

(57) ABSTRACT

In some examples, a print bar fabrication method comprises placing printhead dies face down on a carrier, placing a printed circuit board on the carrier, wire bonding each printhead die of the printhead dies to the printed circuit board, and overmolding the printhead dies and the printed circuit board on the carrier, including fully encapsulating the wire bonds.

13 Claims, 11 Drawing Sheets

Related U.S. Application Data division of application No. 14/770,608, filed as application No. PCT/US2013/062221 on Sep. 27, 2013, now Pat. No. 10,029,467.

(51) Int. Cl.
*B41J 2/155* (2006.01)
*B41J 2/175* (2006.01)

(52) U.S. Cl.
CPC ..... *B41J 2/14072* (2013.01); *B41J 2/14145* (2013.01); *B41J 2/155* (2013.01); *B41J 2/16* (2013.01); *B41J 2/1601* (2013.01); *B41J 2/1603* (2013.01); *B41J 2/1607* (2013.01); *B41J 2/1628* (2013.01); *B41J 2/17526* (2013.01); *B41J 2/17553* (2013.01); *B41J 2002/14362* (2013.01); *B41J 2002/14419* (2013.01); *B41J 2002/14491* (2013.01); *B41J 2202/19* (2013.01); *B41J 2202/20* (2013.01)

(56) References Cited

U.S. PATENT DOCUMENTS 4,521,788 A 6/1985 Kimura
4,633,274 A 12/1986 Matsuda
4,873,622 A 10/1989 Komuro et al.
4,881,318 A 11/1989 Komuro et al.
4,973,622 A 11/1990 Baker et al.
5,016,023 A 5/1991 Chan et al.
5,160,945 A 11/1992 Drake
5,387,314 A 2/1995 Baughman et al.
5,565,900 A 10/1996 Cowger et al.
5,696,544 A 12/1997 Komuro
5,719,605 A * 2/1998 Anderson ..... G03F 7/70425 216/27
5,745,131 A 4/1998 Kneezel et al.
5,841,452 A 11/1998 Silverbrook
5,847,725 A 12/1998 Cleland
5,894,108 A 4/1999 Mostafazadeh et al.
6,022,482 A 2/2000 Chen et al.
6,123,410 A 9/2000 Beerling et al.
6,132,028 A 10/2000 Su et al.
6,145,965 A 11/2000 Inada et al.
6,179,410 B1 1/2001 Kishima
6,188,414 B1 2/2001 Wong et al.
6,190,002 B1 2/2001 Spivey
6,227,651 B1 5/2001 Watts et al.
6,250,738 B1 6/2001 Waller et al.
6,254,819 B1 7/2001 Chatterjee et al.
6,281,914 B1 8/2001 Hiwada et al.
6,291,317 B1 9/2001 Salatino et al.
6,305,790 B1 10/2001 Kawamura et al.
6,341,845 B1 1/2002 Scheffelin
6,379,988 B1 4/2002 Peterson et al.
6,402,301 B1 6/2002 Powers et al.
6,454,955 B1 9/2002 Beerling et al.
6,464,333 B1 10/2002 Scheffelin
6,543,879 B1 4/2003 Feinn et al.
6,554,399 B2 4/2003 Wong et al.
6,560,871 B1 5/2003 Ramos et al.
6,634,736 B2 10/2003 Miyakoshi et al.
6,666,546 B1 12/2003 Buswell et al.
6,676,245 B2 1/2004 Silverbrook
6,767,089 B2 7/2004 Buswell
6,866,790 B2 3/2005 Milligan et al.
6,869,166 B2 3/2005 Brugue
6,896,359 B1 5/2005 Miyazaki et al.
6,930,055 B1 8/2005 Bhowmik et al.
6,938,340 B2 9/2005 Haluzak et al.
6,962,406 B2 11/2005 Kawamura et al.
6,997,540 B2 2/2006 Horvath et al.
7,051,426 B2 5/2006 Buswell
7,185,968 B2 3/2007 Kim et al.
7,188,942 B2 3/2007 Haines et al.
7,238,293 B2 7/2007 Donaldson et al.
7,240,991 B2 7/2007 Timm
7,347,533 B2 3/2008 Elrod et al.
7,490,924 B2 2/2009 Haluzak et al.
7,498,666 B2 3/2009 Hussa
7,543,924 B2 6/2009 Silverbrook
7,547,094 B2 6/2009 Kawamura
7,591,535 B2 9/2009 Nystrom et al.
7,614,733 B2 11/2009 Haines et al.
7,658,467 B2 2/2010 Silverbrook
7,658,470 B1 2/2010 Jones et al.
7,727,411 B2 6/2010 Yamamuro et al.
7,824,013 B2 11/2010 Chung-Long-Shan et al.
7,828,417 B2 11/2010 Haluzak et al.
7,862,147 B2 1/2011 Ciminelli et al.
7,862,160 B2 1/2011 Andrews et al.
7,877,875 B2 2/2011 O'Farrell et al.
8,063,318 B2 11/2011 Williams et al.
8,091,234 B2 1/2012 Ibe et al.
8,101,438 B2 1/2012 McAvoy et al.
8,118,406 B2 2/2012 Ciminelli et al.
8,163,463 B2 4/2012 Kim et al.
8,177,330 B2 5/2012 Suganuma et al.
8,197,031 B2 6/2012 Stephens et al.
8,235,500 B2 8/2012 Nystrom et al.
8,246,141 B2 8/2012 Petruchik et al.
8,272,130 B2 9/2012 Miyazaki
8,287,104 B2 10/2012 Sharan et al.
8,342,652 B2 1/2013 Nystrom et al.
8,405,232 B2 3/2013 Hsu et al.
8,429,820 B2 4/2013 Koyama et al.
8,439,485 B2 5/2013 Tamaru et al.
8,454,130 B2 6/2013 Iinuma
8,476,748 B1 7/2013 Darveaux et al.
8,485,637 B2 7/2013 Dietl
8,496,317 B2 7/2013 Ciminelli
9,446,587 B2 9/2016 Chen
9,724,920 B2 8/2017 Chen et al.
9,731,509 B2 8/2017 Chen
9,844,946 B2 12/2017 Chen
9,944,080 B2 4/2018 Chen et al.
2001/0037808 A1 11/2001 Deem et al.
2002/0024569 A1 2/2002 Silverbrook
2002/0030720 A1 3/2002 Karamura et al.
2002/0033867 A1 3/2002 Silverbrook
2002/0041308 A1 4/2002 Cleland
2002/0051036 A1 5/2002 Scheffelin
2002/0122097 A1 9/2002 Beerling et al.
2002/0180825 A1 12/2002 Buswell et al.
2002/0180846 A1 12/2002 Silverbrook
2003/0007034 A1 1/2003 Horvath et al.
2003/0052944 A1 3/2003 Scheffelin et al.
2003/0081053 A1 5/2003 Barinaga
2003/0090558 A1 5/2003 Coyle
2003/0140496 A1 7/2003 Buswell et al.
2003/0156160 A1 8/2003 Yamaguchi
2003/0169308 A1 9/2003 Audi
2003/0186474 A1 10/2003 Haluzak et al.
2002/0210727 12/2003 Buswell et al.
2004/0032468 A1 2/2004 Killmeier
2004/0055145 A1 3/2004 Buswell
2004/0084404 A1 5/2004 Donaldson
2004/0095422 A1 5/2004 Eguchi et al.
2004/0119774 A1 6/2004 Conta et al.
2004/0196334 A1 10/2004 Cornell
2004/0201641 A1 10/2004 Brugue et al.
2004/0233254 A1 11/2004 Kim
2005/0018016 A1 1/2005 Silverbrook
2005/0024444 A1 2/2005 Conta et al.
2005/0030358 A1 2/2005 Haines et al.
2005/0046663 A1 3/2005 Silverbrook
2005/0116995 A1 6/2005 Tanikawa et al.
2005/0122378 A1 6/2005 Touge
2005/0162466 A1 7/2005 Silverbrook et al.
2006/0022273 A1 2/2006 Halk
2006/0028510 A1 2/2006 Park et al.
2006/0066674 A1 3/2006 Sugahara
2006/0132543 A1 6/2006 Elrod et al.
2006/0175726 A1 8/2006 Kachi

(56) References Cited

U.S. PATENT DOCUMENTS

2006/0209110 A1 9/2006 Vinas et al.
2006/0243387 A1 11/2006 Haluzak et al.
2006/0256162 A1 11/2006 Hayakawa
2006/0280540 A1 12/2006 Han
2007/0139470 A1 6/2007 Lee
2007/0153070 A1 7/2007 Haines et al.
2007/0188561 A1 8/2007 Eguchi et al.
2007/0211095 A1 9/2007 Hirayama
2008/0061393 A1 3/2008 Yen
2008/0079781 A1 4/2008 Shim et al.
2008/0149024 A1 6/2008 Petruchik et al.
2008/0174636 A1 7/2008 Kim et al.
2008/0186367 A1 8/2008 Adkins
2007/0738654 10/2008 Haluzak et al.
2008/0239002 A1 10/2008 Nystrom et al.
2008/0259125 A1 10/2008 Haluzak et al.
2008/0291243 A1 11/2008 Osaki
2008/0292986 A1 11/2008 Park et al.
2008/0297564 A1 12/2008 Jeong et al.
2009/0009559 A1 1/2009 Jindai et al.
2009/0011185 A1 1/2009 Giri
2009/0014413 A1 1/2009 Nystrom et al.
2009/0022199 A1 1/2009 Jikutani et al.
2009/0046125 A1 2/2009 Nystrom et al.
2009/0051717 A1 2/2009 Kuwahara
2009/0086449 A1 4/2009 Minamio et al.
2009/0225131 A1 9/2009 Chen et al.
2009/0256891 A1 10/2009 Anderson
2009/0267994 A1 10/2009 Suganuma et al.
2010/0035373 A1 2/2010 Hunziker et al.
2010/0079542 A1 4/2010 Ciminelli et al.
2010/0132874 A1 6/2010 Anderson et al.
2010/0156989 A1 6/2010 Petruchik
2010/0220148 A1 9/2010 Menzel et al.
2010/0224983 A1 9/2010 Huang et al.
2010/0271445 A1 10/2010 Sharan et al.
2010/0302311 A1 12/2010 Blair et al.
2011/0018941 A1 1/2011 McAvoy et al.
2011/0019210 A1 1/2011 Chung et al.
2011/0020964 A1 1/2011 McAvoy et al.
2011/0037808 A1 2/2011 Ciminelli et al.
2011/0080450 A1* 4/2011 Ciminelli ..... B41J 2/16 29/890.1
2011/0115852 A1* 5/2011 Bibi ..... B41J 2/135 347/56
2011/0141691 A1 6/2011 Slaton et al.
2011/0222239 A1 9/2011 Dede
2011/0292121 A1 12/2011 McAvoy et al.
2011/0292124 A1 12/2011 Anderson
2011/0292126 A1 12/2011 Nystrom et al.
2011/0296688 A1 12/2011 Fielder et al.
2011/0298868 A1 12/2011 Fielder et al.
2011/0304673 A1 12/2011 Ciminelli et al.
2012/0000595 A1 1/2012 Mase et al.
2012/0003902 A1 1/2012 Mase
2012/0019593 A1 1/2012 Scheffelin et al.
2012/0061857 A1 3/2012 Ramadoss et al.
2012/0098114 A1 4/2012 Ishibashi
2012/0120158 A1 5/2012 Sakai et al.
2012/0124835 A1 5/2012 Okano et al.
2012/0132874 A1 6/2012 Anderson et al.
2012/0154486 A1 6/2012 Anderson et al.
2012/0186079 A1* 7/2012 Ciminelli ..... B41J 2/14072 29/841
2012/0188307 A1 7/2012 Ciminelli
2012/0210580 A1 8/2012 Dietl
2012/0212540 A1 8/2012 Dietl
2012/0242752 A1 9/2012 Mou et al.
2013/0026130 A1 1/2013 Watanabe
2013/0027466 A1 1/2013 Petruchik et al.
2013/0029056 A1 1/2013 Asai et al.
2013/0194349 A1 8/2013 Ciminelli et al.
2013/0201256 A1 8/2013 Fricke et al.
2013/0320471 A1 12/2013 Luan
2014/0028768 A1 1/2014 Chen
2016/0001552 A1* 1/2016 Chen ..... B41J 2/1607 347/44
2016/0001558 A1 1/2016 Chen et al.
2016/0009084 A1 1/2016 Chen et al.
2016/0009085 A1 1/2016 Chen
2016/0016404 A1 1/2016 Chen et al.
2017/0008281 A1 1/2017 Chen et al.
2018/0141337 A1 5/2018 Chen et al.
2018/0326724 A1 11/2018 Chen et al.

FOREIGN PATENT DOCUMENTS

CN 1286172 3/2001
CN 1297815 6/2001
CN 1314244 9/2001
CN 1512936 7/2004
CN 1530229 9/2004
CN 1541839 11/2004
CN 1593924 3/2005
CN 1622881 6/2005
CN 1872554 12/2006
CN 1903578 1/2007
CN 1903579 1/2007
CN 101020389 8/2007
CN 101085573 12/2007
CN 101124519 2/2008
CN 101163591 4/2008
CN 101274514 10/2008
CN 101274515 10/2008
CN 101274523 10/2008
CN 101372172 2/2009
CN 101607477 12/2009
CN 101668696 3/2010
CN 101668698 A 3/2010
CN 101909893 12/2010
CN 102470672 5/2012
CN 102596575 7/2012
CN 102673155 9/2012
CN 102689511 9/2012
CN 102689512 9/2012
CN 102971151 A 3/2013
CN 103052508 4/2013
DE 102011078906 1/2013
DE 102011084582 2/2013
EP 0705698 4/1996
EP 0755793 A2 1/1997
EP 0822078 A2 2/1998
EP 1027991 8/2000
EP 1095773 5/2001
EP 1080907 7/2001
EP 1264694 A1 12/2002
EP 1386740 2/2004
EP 1518685 3/2005
EP 1827844 9/2007
EP 1908593 4/2008
JP 60262649 12/1985
JP 61125852 6/1986
JP 62240562 10/1987
JP H04-292950 10/1992
JP H06-015824 1/1994
JP H06-226977 8/1994
JP H07-227970 8/1995
JP H09-001812 1/1997
JP H09-029970 2/1997
JP H09-131871 5/1997
JP H11-091108 4/1999
JP H11-208000 8/1999
JP 2001071490 3/2001
JP 2000108360 4/2001
JP 2001-246748 9/2001
JP 2004-517755 7/2002
JP 2002291262 10/2002
JP 2003-011365 1/2003
JP 2003-063010 3/2003
JP 2003-063020 3/2003
JP 2004-148827 5/2004
JP 2005-088587 4/2005
JP 2005161710 6/2005
JP 2005212134 8/2005

(56) References Cited

FOREIGN PATENT DOCUMENTS

| | | | |
|---|---|---|---|
| JP | 2006-009149 | | 1/2006 |
| JP | 2006224624 | A | 8/2006 |
| JP | 2006-315321 | A | 11/2006 |
| JP | 2006315321 | | 11/2006 |
| JP | 2006321222 | | 11/2006 |
| JP | 2007531645 | | 11/2007 |
| JP | 2008-009149 | A | 1/2008 |
| JP | 2008-087478 | | 4/2008 |
| JP | 2008-511130 | | 4/2008 |
| JP | 2009-255448 | | 11/2009 |
| JP | 2010023341 | | 2/2010 |
| JP | 2010050452 | | 3/2010 |
| JP | 2010137460 | | 6/2010 |
| JP | 2010-524713 | | 7/2010 |
| JP | 2011-240516 | | 12/2011 |
| JP | 2012-158150 | | 8/2012 |
| JP | 2013501655 | | 1/2013 |
| JP | 2015-217679 | A | 12/2015 |
| KR | 20020025590 | | 4/2002 |
| KR | 20040097848 | | 11/2004 |
| KR | 20120079171 | | 7/2012 |
| TW | 501979 | | 9/2002 |
| TW | 503181 | | 9/2002 |
| TW | I295632 | | 4/2008 |
| TW | 200903685 | A | 1/2009 |
| TW | 200926385 | A | 6/2009 |
| TW | 200932658 | A | 8/2009 |
| TW | 200936385 | | 9/2009 |
| TW | 201144081 | | 12/2011 |
| WO | WO-2006066306 | | 6/2006 |
| WO | WO-2008134202 | | 11/2008 |
| WO | WO-2008151216 | | 12/2008 |
| WO | WO-2010005434 | | 1/2010 |
| WO | 2011/001952 | A1 | 1/2011 |
| WO | WO-2011019529 | | 2/2011 |
| WO | WO-2011019529 | A1 | 2/2011 |
| WO | WO-2011058719 | | 5/2011 |
| WO | WO-2012011972 | | 1/2012 |
| WO | WO-2012023939 | | 2/2012 |
| WO | WO-2012023941 | | 2/2012 |
| WO | WO-2012106661 | | 8/2012 |
| WO | WO-2012134480 | | 10/2012 |
| WO | WO-2012168121 | | 12/2012 |
| WO | WO-2013016048 | | 1/2013 |
| WO | 2014/013356 | A1 | 1/2014 |
| WO | WO-2014133516 | | 9/2014 |
| WO | WO-2014133561 | | 9/2014 |
| WO | WO-2014133575 | | 9/2014 |
| WO | WO-2014133576 | | 9/2014 |
| WO | WO-2014133577 | | 9/2014 |
| WO | WO-2014133578 | | 9/2014 |
| WO | WO-2014133600 | | 9/2014 |
| WO | WO-2014153305 | | 9/2014 |

OTHER PUBLICATIONS

Yim, M.J et al.; Ultra Thin Pop Top Package Using Compression Mold;iT'S Warpage Contorl; http://ieeexplore.IEEE.org/xpl/articleDetails.jsp?tp=&arnumber=5898654&queryText%3Dmold+cap+thick* > May 31-Jun. 3, 2011, pp. 1141-1146.

Chen Yue Cheng et al.; A Monolithic Thermal Inkjet Printhead Combining Anisotropic Etching and Electro Plating; In Input/Output and Imaging Technologies II, 246 Proceedings of SPIE vol. 4080 Jul. 26-27, 2007; pp. 245-252.

European Patent Office, Communication pursuant to Rule 164(1) EPC for Appl. No. 13876407.1 dated Jan. 5, 2017 (7 pages).

European Patent Office, Extended European Search Report for Appl. No. 13876407.1 dated May 31, 2017 (18 pages).

Hayes, D.J. et al.; Microjet Printing of Solder and Polymers for Multi-chip Modules and Chip-scale Packages; May 14, 1999 (6 pages) http://citeseerx.ist.psu.edu/viewdoc/download?doi=10.1.1.88.3951&rep=rep1&type=pdf >.

Korean Intellectual Property Office, International Search Report and Written Opinion for PCT/US2013/062221 dated Dec. 19, 2013 (13 pages).

Kumar, Aditya et al.; Wafer Level Embedding Technology for 3D Wafer Level Embedded Package; Institute of Microelectronics, A*Star; 2Kinergy Ltd, TECHplace II; 2009 Electronic Components and Technology Conference.

Lee, J-D et al.; A Thermal Inkjet Printhead with a Monolithically Fabricated Nozzle Plate and Self-aligned Ink Feed Hole; http://ieeexplore.IEEE.org/stamp/stamp.jsp?tp=&arnumber=788625 > on pp. 229-236; vol. 8; Issue: 3; Sep. 1999.

Lindemann, T. et al.; One Inch Thermal Bubble Jet Printhead with Laser Structured Integrated Polyimide Nozzle Plate; http://ieeexplore.ieee.org/stamp/stamp.jsp?tp=&arnumber=4147592 > on pp. 420-428; vol. 16; Issue: 2 ; Apr. 2007.

Miettinen et al; Molded Substrates for Inkjet Printed Modules; IEEE Transactions on Components and Packaging Technologies, vol. 32, No. 2, Jun. 2009 293; pp. 293-301.

* cited by examiner

MOLDED PRINTHEAD

CROSS REFERENCE TO RELATED APPLICATIONS

This application is a continuation of Ser. No. 16/025,222, filed Jul. 2, 2018, which is a divisional of U.S. application Ser. No. 14/770,608, filed on Aug. 26, 2015, now issued as U.S. Pat. No. 10,029,467 on Jul. 24, 2018, which is a national stage application under 35 U.S.C. § 371 of PCT/US2013/062221, filed Sep. 27, 2013, which claims priority from International Appl. No. PCT/US2013/028216, filed Feb. 28, 2013, and International Appl. No. PCT/US2013/046065, filed Jun. 17, 2013, which are all hereby incorporated by reference in their entirety.

BACKGROUND

Conventional inkjet printheads require fluidic fan-out from microscopic ink ejection chambers to macroscopic ink supply channels.

DRAWINGS

The same part numbers designate the same or similar parts throughout the figures. The figures are not necessarily to scale. The relative size of some parts is exaggerated to more clearly illustrate the example shown.

DESCRIPTION

Conventional inkjet printheads require fluidic fan-out from microscopic ink ejection chambers to macroscopic ink supply channels. Hewlett-Packard Company has developed new, molded inkjet printheads that break the connection between the size of the die needed for the ejection chambers and the spacing needed for fluidic fan-out, enabling the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. Although this new approach has many advantages, one challenge is making robust electrical connections between the printhead dies and external wiring that withstand ink and mechanical stresses while not interfering with low cost capping and servicing.

To help meet this challenge, a new molded printhead has been developed in which, for one example configuration, the electrical connections are moved to the back of the printhead die and embedded in the molding. This configuration allows mechanically robust connections that are largely protected from exposure to ink and, because there are no electrical connections along the front face of the die, the printhead can be made flat and thus minimize protruding structures that might interfere with printhead-to-paper spacing and/or capping and servicing. In one example implementation, described in detail below, a page wide molded print bar includes multiple printheads with bond wires buried in the molding. The electrical connections are routed from the back of each printhead die through a printed circuit board embedded in the molding to enable a continuous planar surface across the front face of the print bar where the ejection orifices are exposed to dispense printing fluid.

Examples of the new printhead are not limited to page wide print bars, but may be implemented in other structures or assemblies. As used in this document, a "printhead" and a "printhead die" mean that part of an inkjet printer or other inkjet type dispenser that dispenses fluid from one or more openings, and a die "sliver" means a printhead die with a ratio of length to width of 50 or more. A printhead includes one or more printhead dies. "Printhead" and "printhead die" are not limited to printing with ink and other printing fluids but also include inkjet type dispensing of other fluids and/or for uses other than printing. The examples shown in the Figures and described herein illustrate but do not limit the invention, which is defined in the Claims following this Description.

Figure 1:
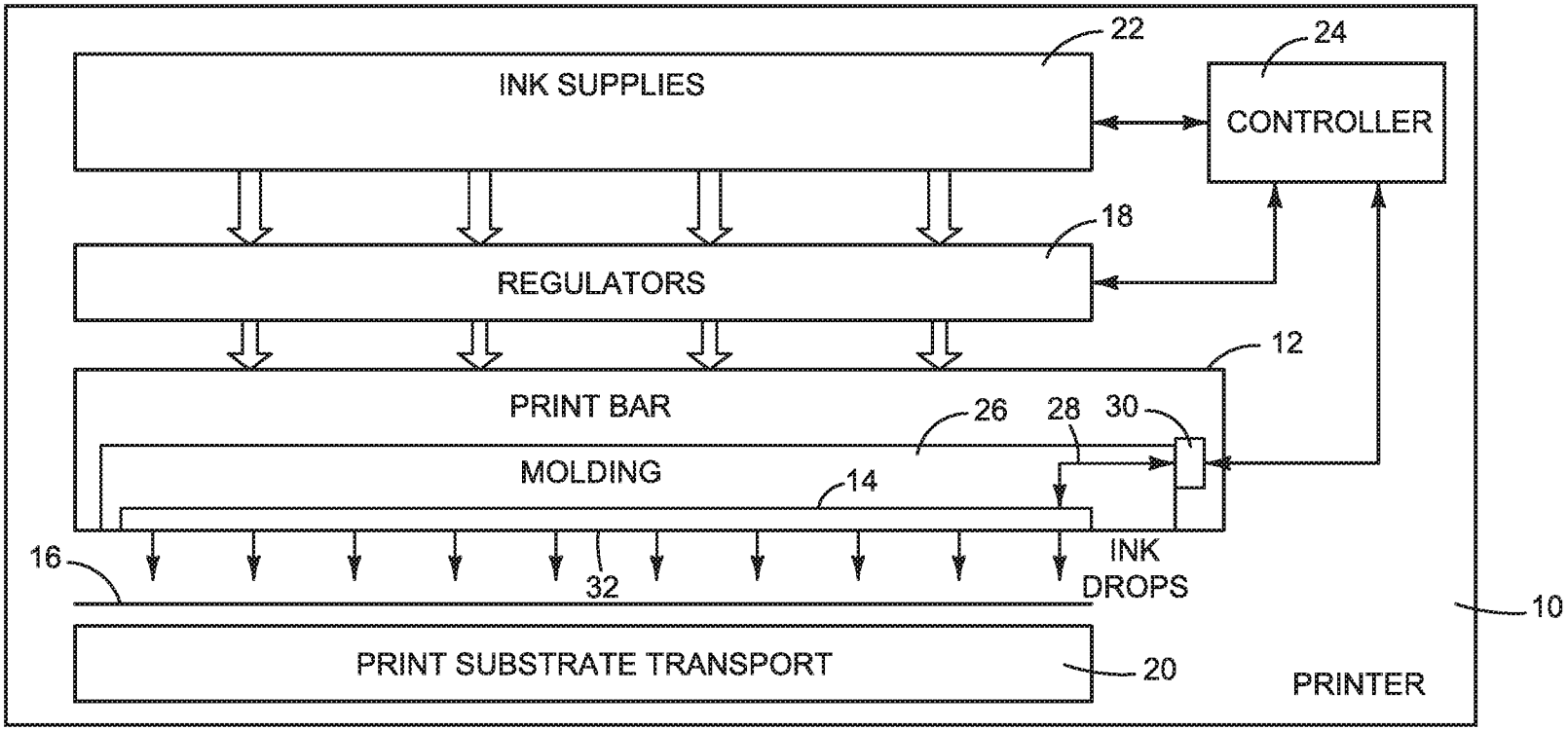
FIG. 1 is a block diagram illustrating an inkjet printer with a media wide print bar implementing one example of a new molded printhead.

FIG. 1 is a block diagram illustrating an inkjet printer 10 with a media wide print bar 12 implementing one example of a molded printhead 14. Referring to FIG. 1, printer 10 includes a print bar 12 spanning the width of a print media 16, flow regulators 18 associated with print bar 12, a media transport mechanism 20, ink or other printing fluid supplies 22, and a printer controller 24. Controller 24 represents the programming, processor(s) and associated memory(ies), and the electronic circuitry and components needed to control the operative elements of a printer 10. Print bar 12 includes an arrangement of one or more molded printheads 14 for dispensing printing fluid on to a sheet or continuous web of paper or other print media 16. Print bar 12 in FIG. 1 includes one or more printheads 14 embedded in a molding 26 spanning print media 16. The electrical connections 28 between printhead(s) 14 and the contacts 30 to external circuits are routed from the back of each printhead 14 and buried in molding 26 to allow a single uninterrupted planar surface along the front face 32 of printhead(s) 14.

Figure 2:
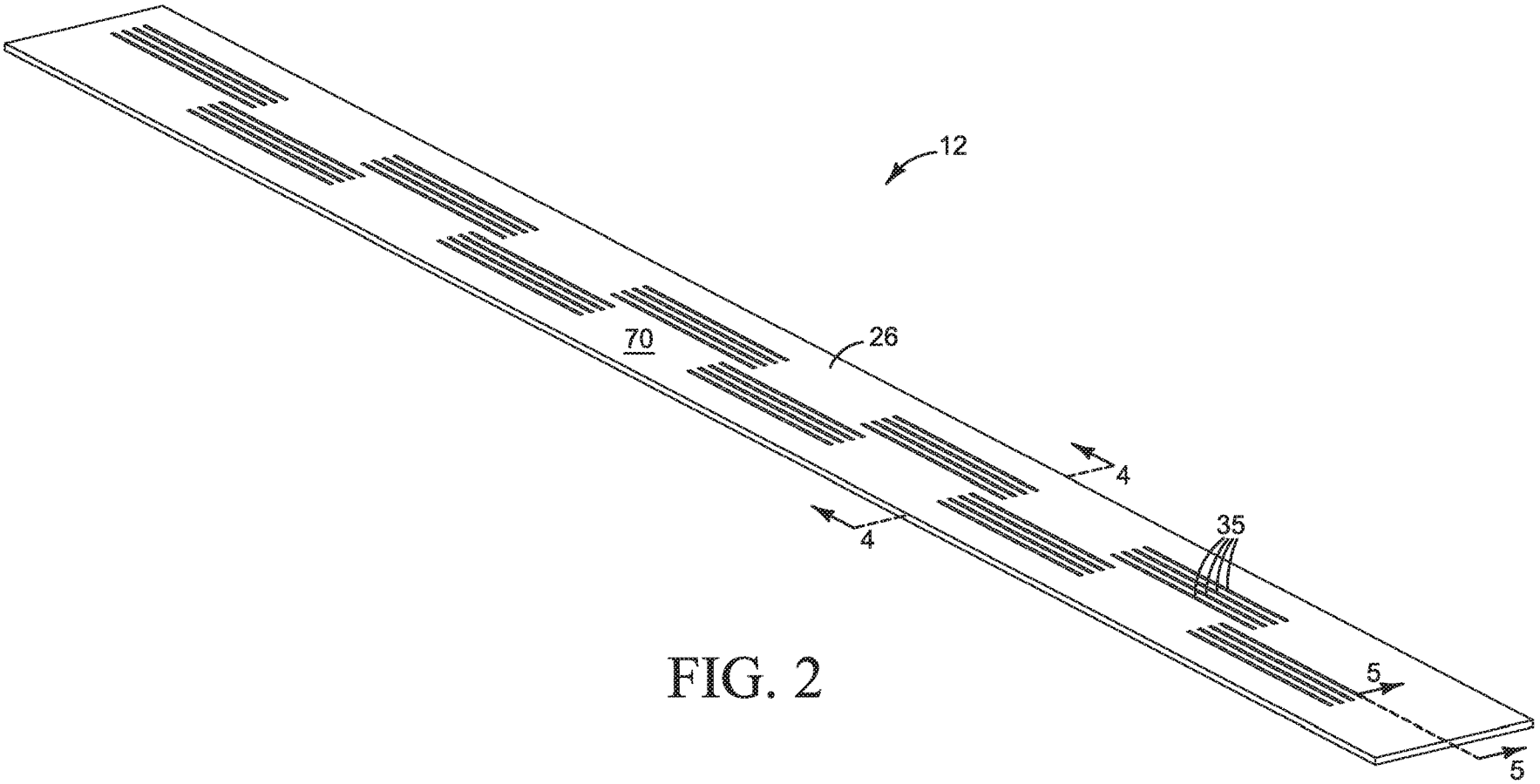
FIGS. 2 and 3 are back-side and front-side perspective views, respectively, illustrating one example of a molded print bar with multiple printheads such as might be used in the printer shown in FIG. 1.
Figure 3:
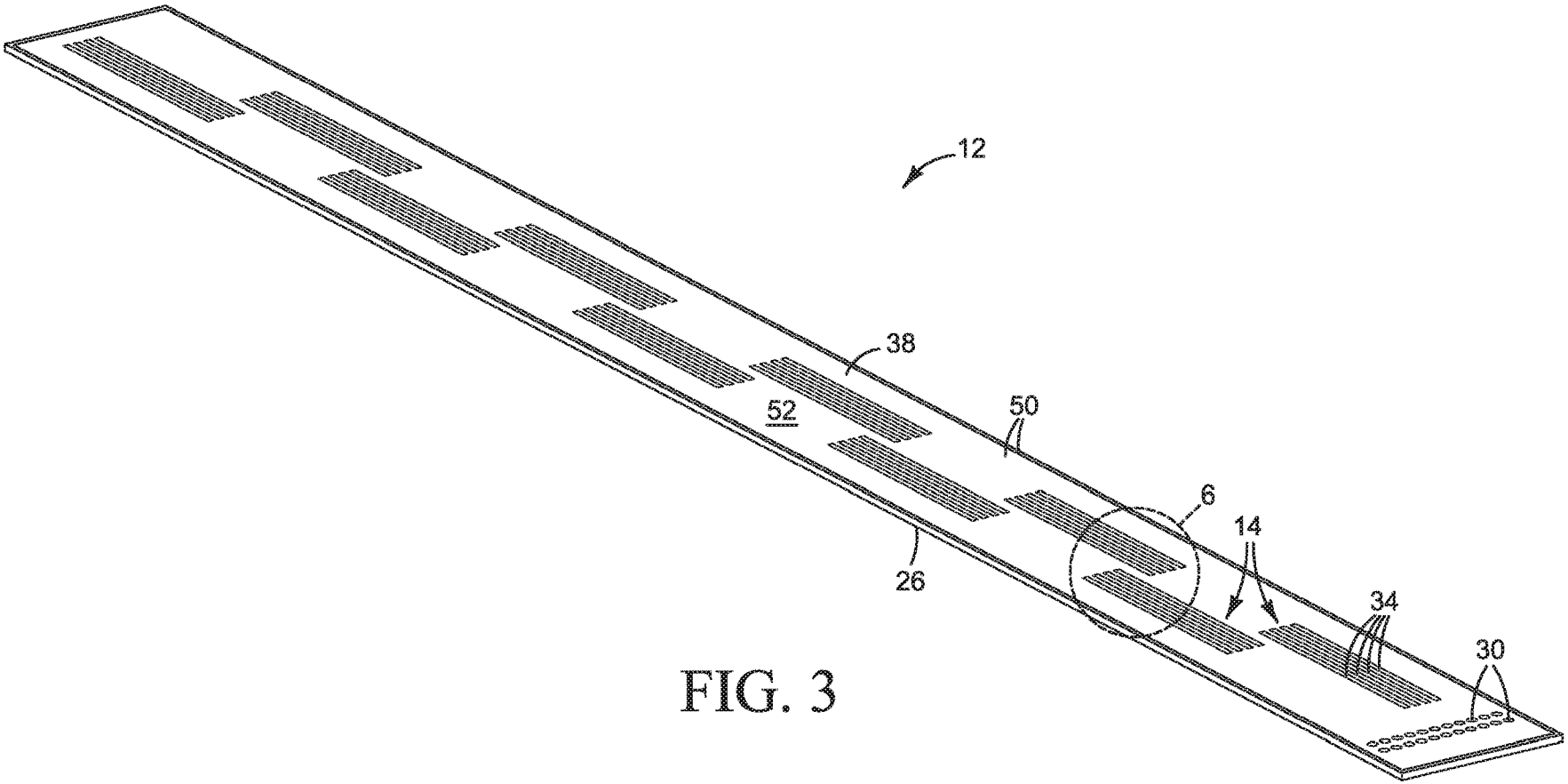
Figure 4:
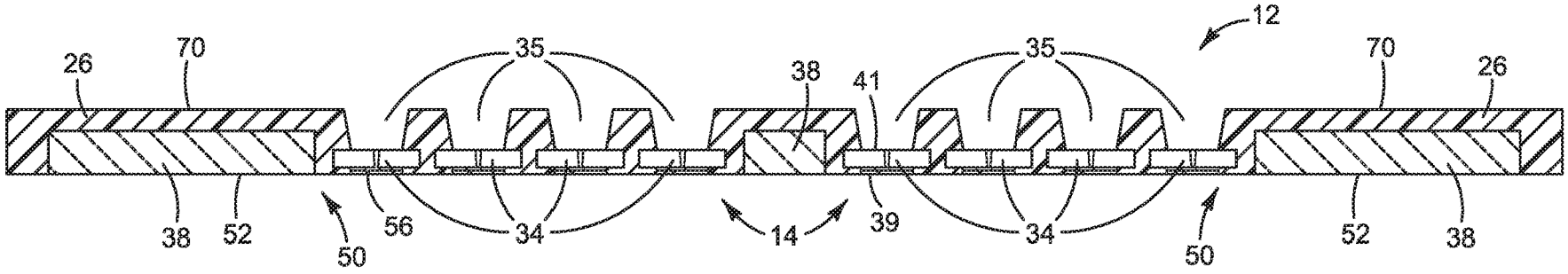
FIG. 4 is a section view taken along the line 4-4 in FIG. 2.
Figure 5:
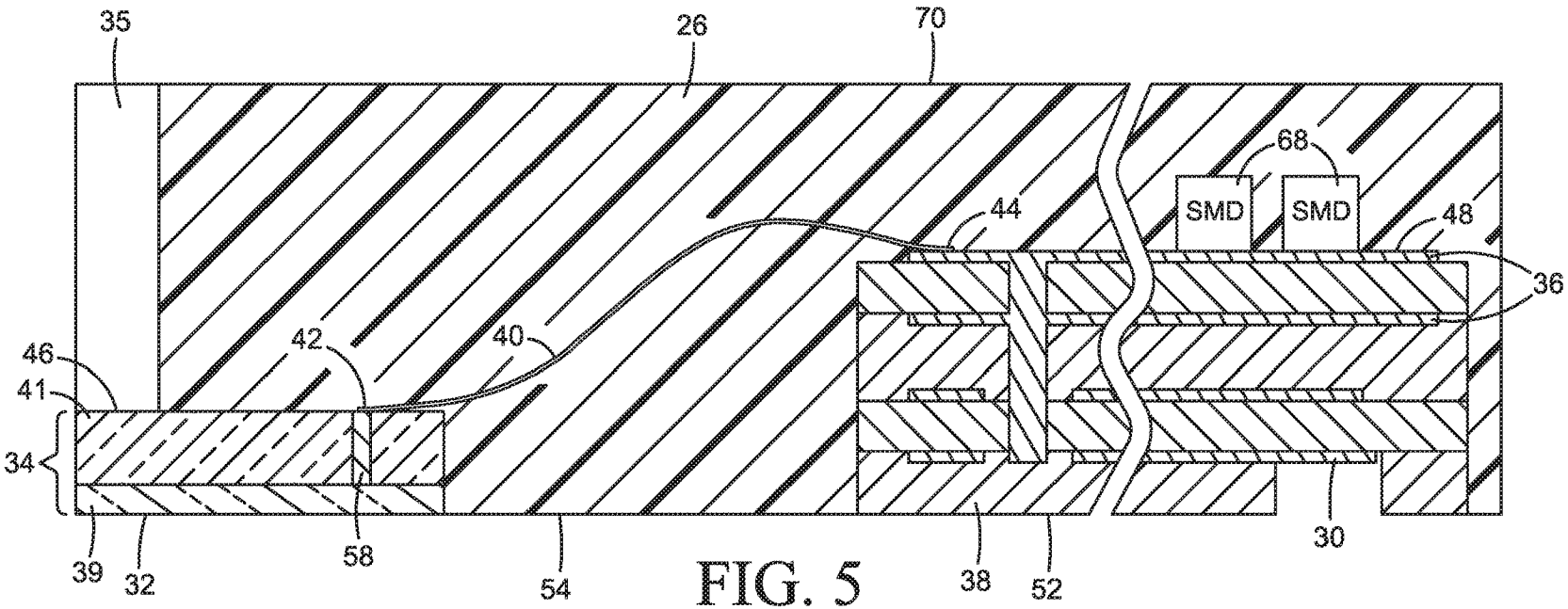
FIG. 5 is a section view taken along the line 5-5 in FIG. 2.
Figure 6:
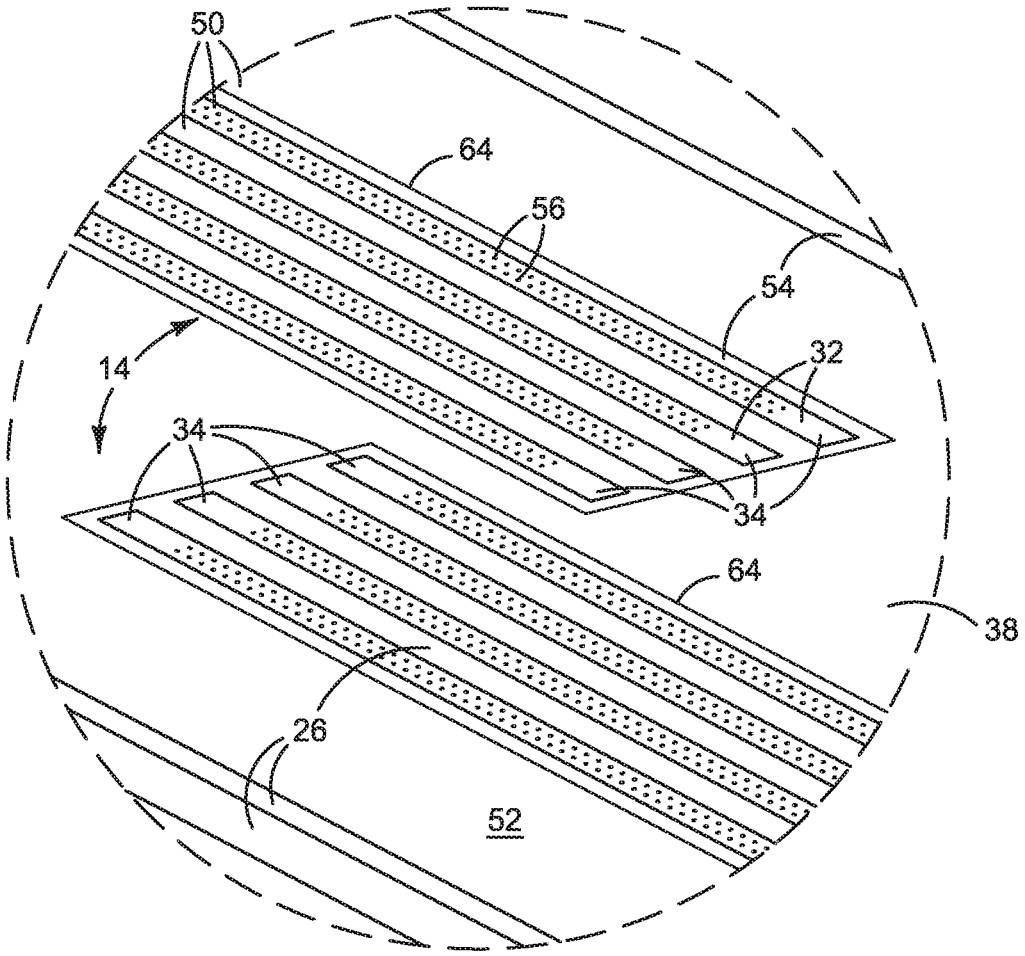
FIG. 6 is a detail view from FIG. 3.

FIGS. 2 and 3 are back-side and front-side perspective views, respectively, illustrating one example of a molded print bar 12 with multiple printheads 14 such as might be used in printer 10 shown in FIG. 1. FIGS. 4 and 5 are section views taken along the lines 4-4 and 5-5 in FIG. 2. FIG. 6 is a detail from FIG. 3. Referring to FIGS. 2-6, print bar 12 includes multiple printheads 14 embedded in a monolithic molding 26 and arranged in a row lengthwise across the print bar in a staggered configuration in which each printhead overlaps an adjacent printhead. Although ten printheads 14 are shown in a staggered configuration, more or fewer printheads 14 may be used and/or in a different configuration. Examples are not limited to a media wide print print bar. Examples could also be implemented in a scanning type inkjet pen or printhead assembly with fewer molded printheads, or even a single molded printhead.

Each printhead 14 includes printhead dies 34 embedded in molding 26 and channels 35 formed in molding 26 to carry printing fluid directly to corresponding printhead dies 34. Although four dies 34 arranged parallel to one another laterally across molding 26 are shown, for printing four different ink colors for example, more or fewer printhead dies 34 and/or in other configurations are possible. As noted above, the development of the new, molded inkjet printheads has enabled the use of tiny printhead die "slivers" such as those described in international patent application no. PCT/US2013/046065, filed Jun. 17, 2003 and titled Printhead Die. The molded printhead structures and electrical interconnections described herein are particularly well suited to the implementation of such tiny die slivers 34 in printheads 14.

In the example shown, the electrical conductors 36 that connect each printhead die 34 to external circuits are routed through a printed circuit board (PCB) 38. A printed circuit board is also commonly referred to as a printed circuit assembly (a "PCA"). An inkjet printhead die 34 is a typically complex integrated circuit (IC) structure 39 formed on a silicon substrate 41. Conductors 36 in PCB 38 carry electrical signals to ejector and/or other elements of each printhead die 34. As shown in FIG. 5, PCB conductors 36 are connected to circuitry in each printhead die 34 through bond wires 40. Although only a single bond wire 40 is visible in the section view of FIG. 5, multiple bond wires 40 connect each printhead die 34 to multiple PCB conductors 36.

Each bond wire 40 is connected to bond pads or other suitable terminals 42, 44 at the back part 46, 48 of printhead dies 34 and PCB 38, respectively, and then buried in molding 26. (Bond wires 40 and bond pads 42, 44 are also shown in the fabrication sequence views of FIGS. 8 and 9.) Molding 26 fully encapsulates bond pads 42, 44 and bond wires 40. "Back" part in this context means away from the front face 50 of print bar 12 so that the electrical connections can be fully encapsulated in molding 26. This configuration allows the front faces 32, 52, 54 of dies 34, molding 26, and PCB 38, respectively, to form a single uninterrupted planar surface/face 50 along ink ejection orifices 56 at the face 32 of each die 34, as best seen in the section view of FIG. 4.

Although other conductor routing configurations are possible, a printed circuit board provides a relatively inexpensive and highly adaptable platform for conductor routing in molded printheads. Similarly, while other configurations may be used to connect the printhead dies to the PCB conductors, bond wire assembly tooling is readily available and easily adapted to the fabrication of printheads 14 and print bar 12. For printhead dies 34 in which the internal electronic circuitry is formed primarily away from the back of the dies, through-silicon vias (TSV) 58 are formed in each die 34 to connect bond pads 42 at the back of the die 34 to the internal circuitry, as shown in FIG. 5. TSVs are not needed for die configurations that have internal circuitry already at the back of the die.

Figure 7:
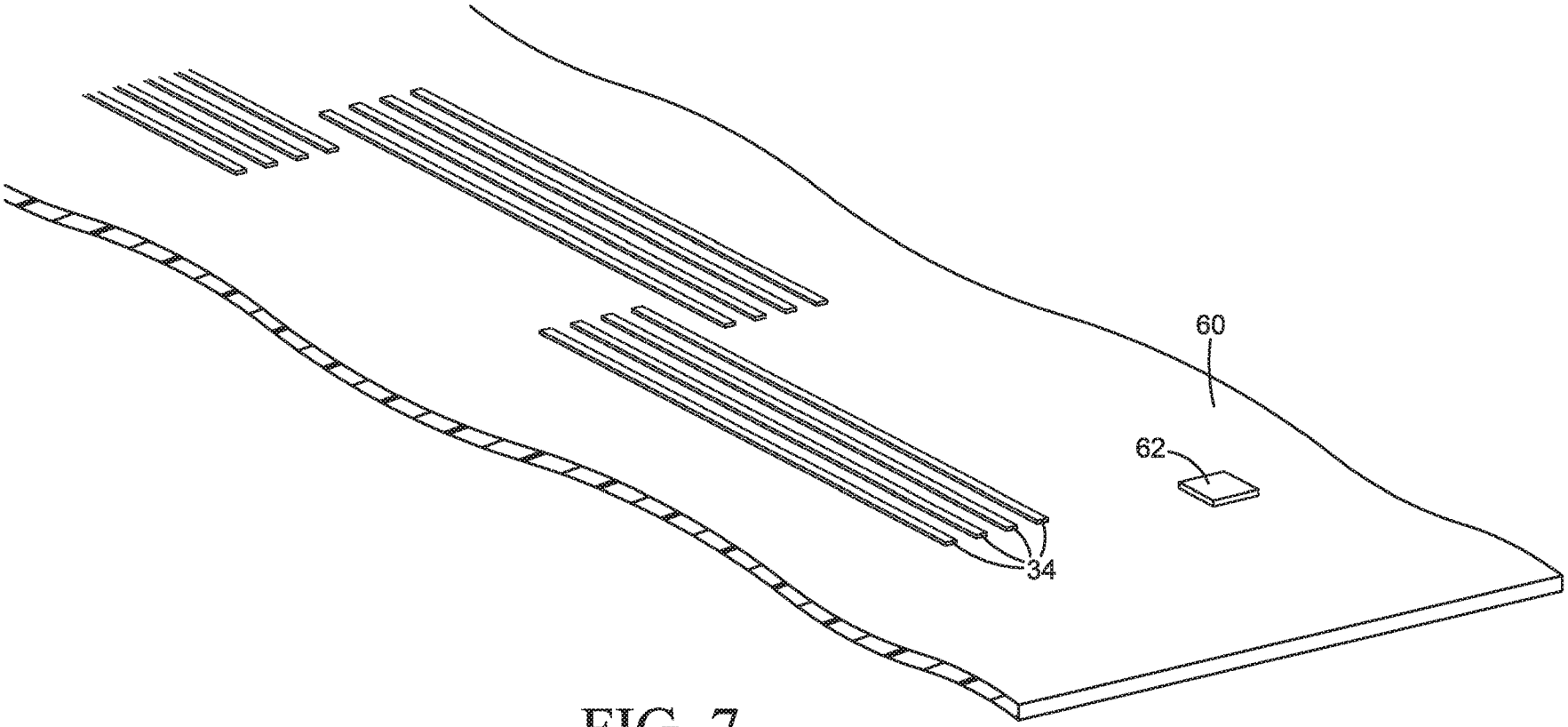
FIGS. 7-11 illustrate one example process for making a print bar such as the print bar shown in FIGS. 2-6.
Figure 8:
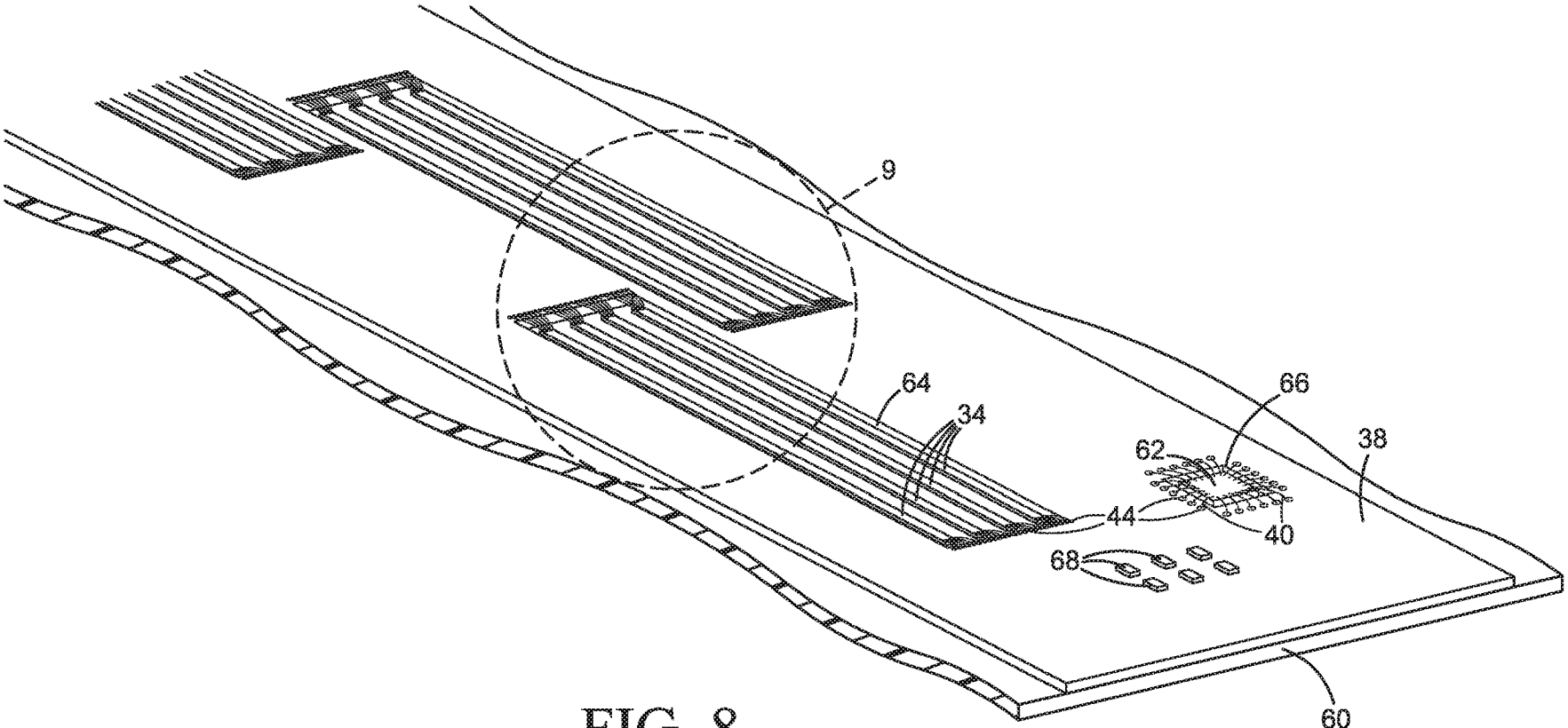
Figure 9:
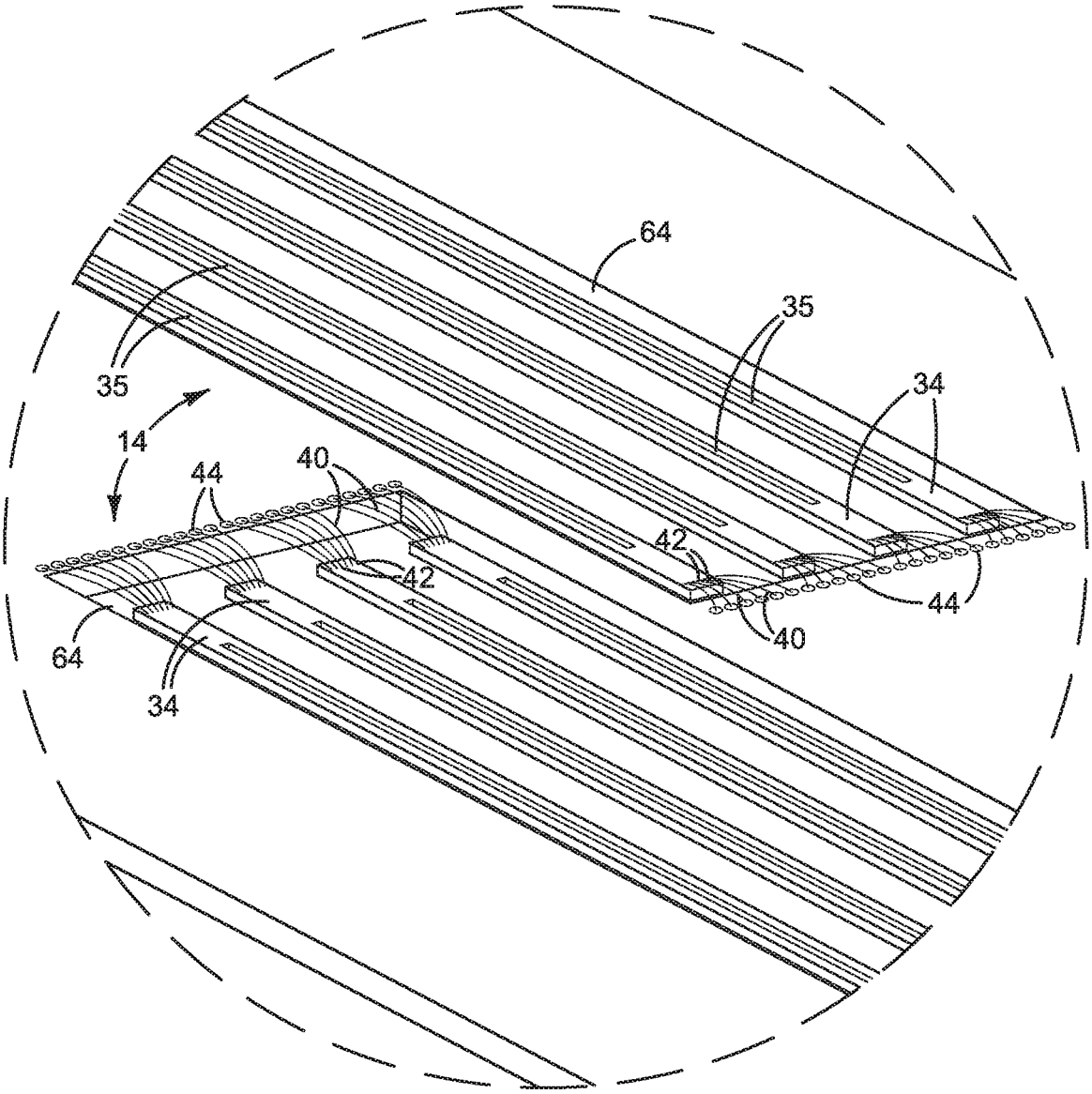
Figure 11:
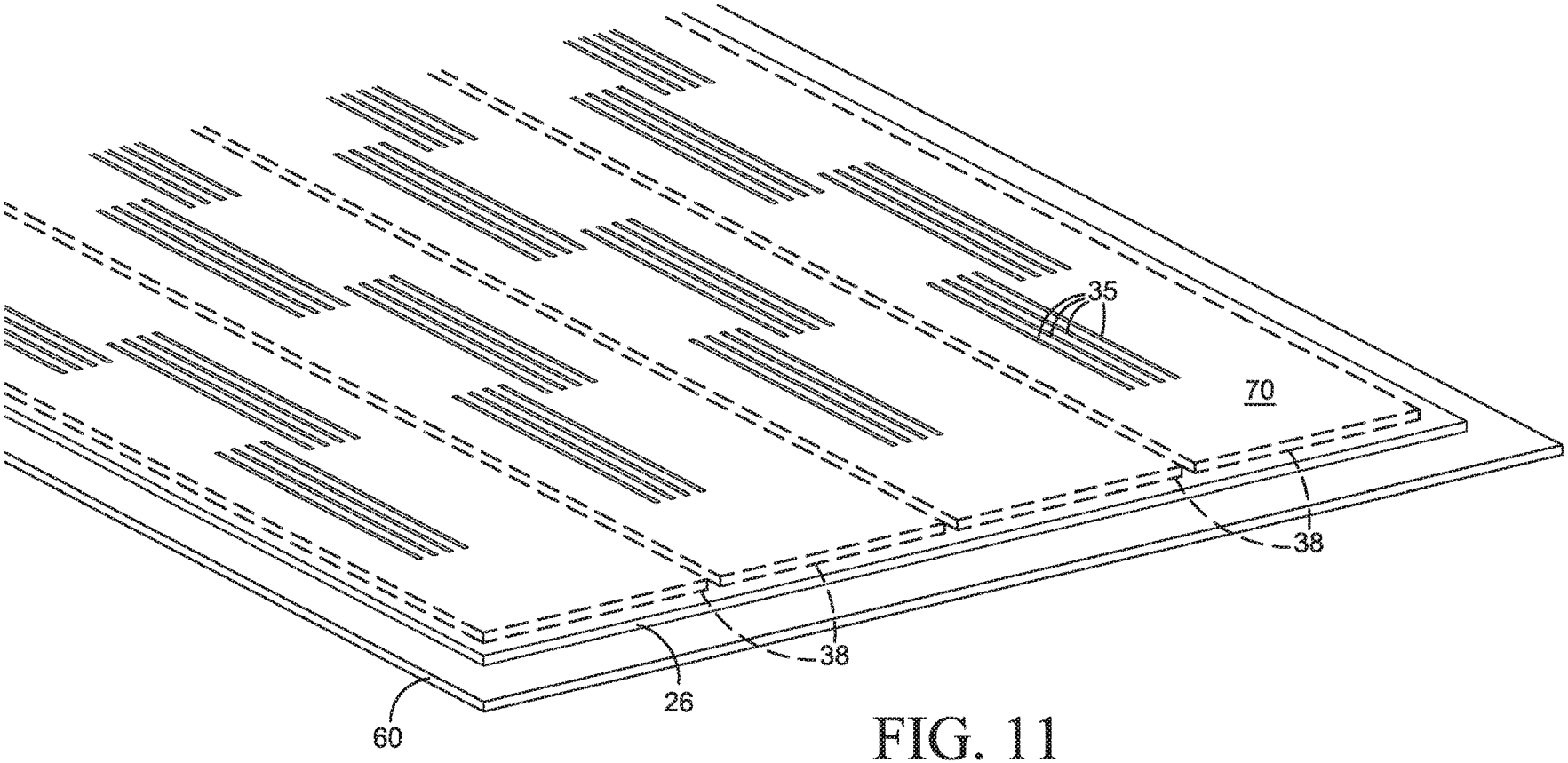
Figure 12:
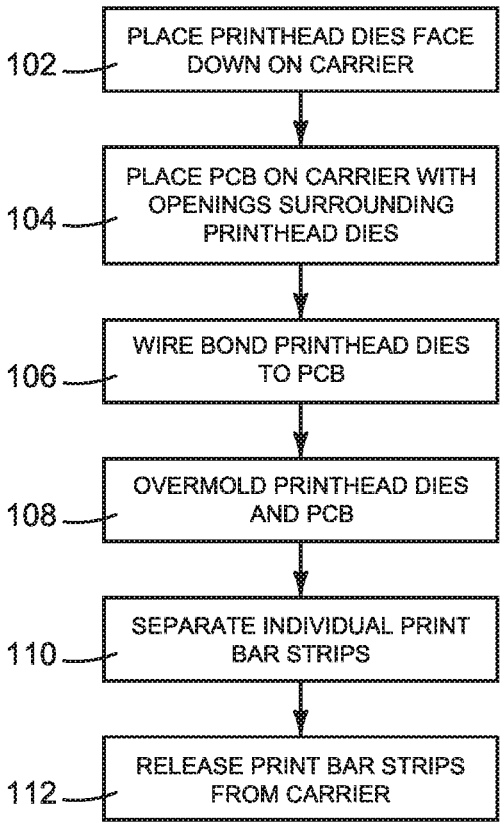
FIG. 12 is a flow diagram of the process illustrated in FIGS. 7-11.

One example process for making a print bar 12 will now be described with reference to FIGS. 7-11. FIG. 12 is a flow diagram of the process illustrated in FIGS. 7-11. Referring first to FIG. 7, printhead dies 34 are placed on a carrier 60 with a thermal tape or other suitable releasable adhesive (step 102 in FIG. 12). In the example shown, an application specific integrated circuit (ASIC) chip 62 is also placed on carrier 60. Then, as shown in FIGS. 8 and 9, PCB 38 is placed on carrier 60 with openings 64 surrounding printhead dies 34 and opening 66 surrounding ASIC 62 (step 104 in FIG. 12). Conductors in PCB 38 are then wire bonded or otherwise electrically connected to dies 34 and ASIC 62 (step 106 in FIG. 12). Surface mounted devices (SMDs) 68 may be included with PCB 38 as necessary or desirable for each print bar 12. One of the advantages of a molded print bar 12 with PCB conductor routing is the ease with which other components, such as ASIC 62 and SMDs 68, may be incorporated into the print bar.

Figure 10:
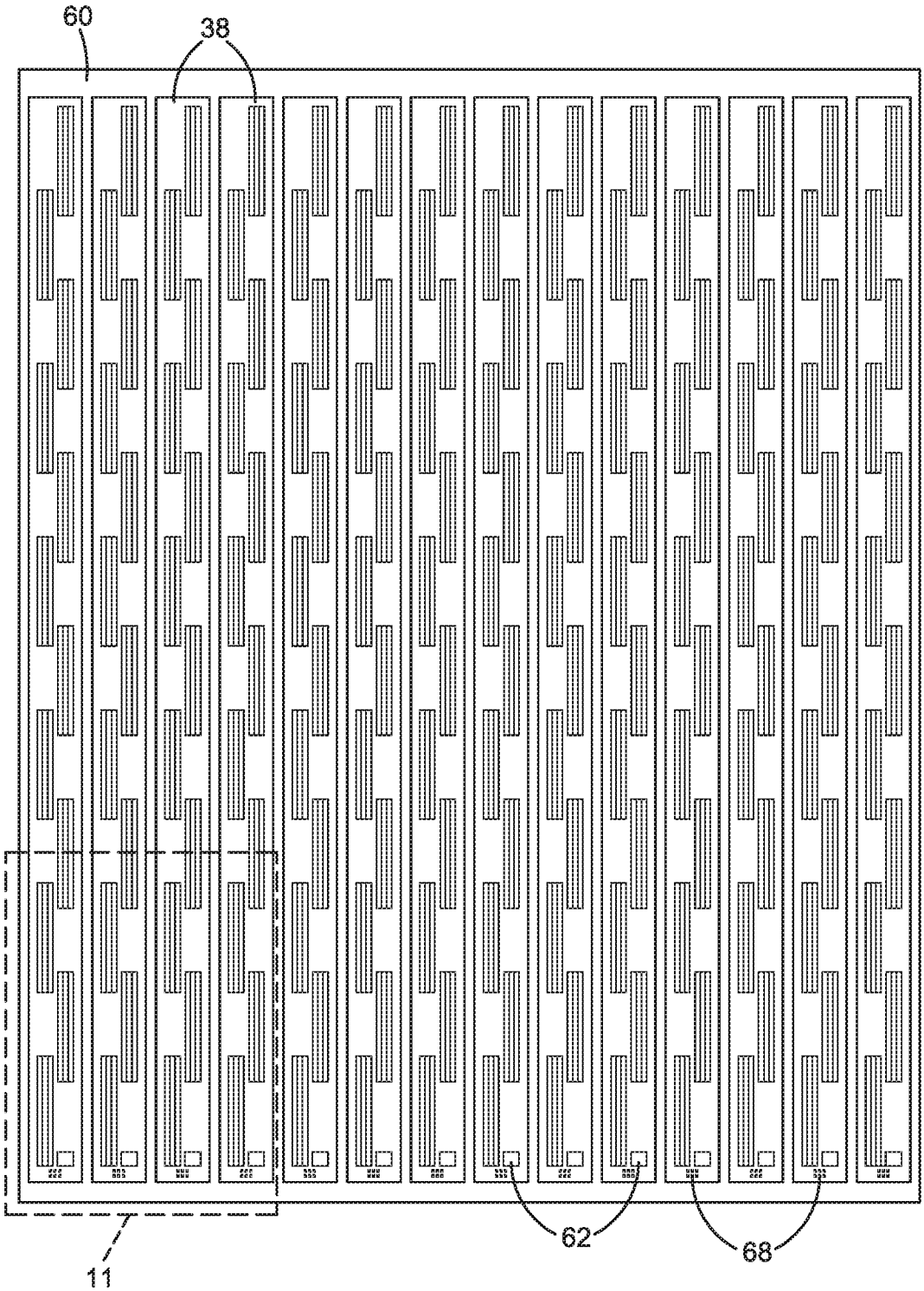

FIG. 10 is a plan view showing the lay-out of multiple in-process print bars from FIG. 8 on a carrier panel 60. PCBs 38 and printhead dies 34 on panel 60 are overmolded with an epoxy mold compound or other suitable moldable material 26 (step 108 in FIG. 12), as shown in FIG. 11, and then individual print bar strips are separated (step 110 in FIG. 12) and released from carrier 60 (step 112 in FIG. 12) to form individual print bars 12 shown in FIGS. 2-6. The molded structure may be separated into strips and the strips released from carrier 60 or the molded structure may be released from carrier 60 and then separated into strips. Any suitable molding technique may be used including, for example, transfer molding and compression molding. Channels 35 in molding 26 formed during overmolding may extend through to expose printhead dies 34. Alternatively, channels 35 formed during overmolding may extend only partially through molding 26 and powder blasted or otherwise opened to expose printhead dies 34 in a separate processing step.

Overmolding printhead dies 34 and PCB 38 placed face-down on carrier 60 produces a continuous planar surface across the front face 50 of each print bar 12 where ejection orifices 56 are exposed to dispense printing fluid. As best seen in FIG. 6, print bar face 50 is a composite of die faces 32, PCB face 52 and the face 54 of molding 26 surrounding dies 34 and PCB 38. If necessary or desirable to the particular implementation of print bar 12, the rear face 70 of molding 26 may be molded flat as well to make a completely flat print bar 12 (except at channels 35, of course). The use of a single adhesive, molding 26, to both hold the printhead dies 34 apart and encapsulate the electrical connections not only simplifies the printhead structure but also helps reduce material costs as well as fabrication process costs. In addition, an electrical RDL (redistribution layer) is unnecessary, an inexpensive PCB 38 performs the RDL function, and only a single level of electrical interconnect is used to connect each die 34 to PCB 38, to further simplify the structure and reduce fabrication costs.

"A" and "an" as used in the Claims means one or more.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A printhead, comprising:

a printhead die having a front face along which fluid is to be dispensed from the printhead die and a back part away from the front face; and an electrical connection between the back part of the printhead die and an electrical component, wherein a portion of the back part of the printhead die is in physical contact with a monolithic molding, wherein the electrical connection is fully encapsulated in the monolithic molding, and wherein the monolithic molding comprises a channel therein through which fluid can pass directly from the channel to the back part of the printhead die in the absence of an intervening structure between the channel and the back part of the printhead die.

2. The printhead of claim 1, wherein the electrical connection includes a bond wire.

3. The printhead of claim 1, wherein the back part of the printhead die is in physical contact with the monolithic molding except at the channel.

4. The printhead of claim 1, wherein the front face of the printhead die is exposed outside of the monolithic molding.

5. The printhead of claim 1, wherein the electrical connection comprises an electrical connection between a bond pad on the back part of the printhead die and a bond pad on the electrical component.

6. The printhead of claim 1, wherein the electrical component is an electrical redistribution layer.

7. The printhead of claim 1, wherein the electrical component is a printed circuit board.

8. A printhead, comprising:

a printhead die comprising a front face along which fluid, when present, is to be dispensed and a back part away from the front face, the printhead die molded into a monolithic molding, wherein a portion of the back part of the printhead die is in physical contact with the monolithic molding, wherein the monolithic molding has a channel therein through which fluid is to pass directly from the channel to the back part of a printhead die in the absence of an intervening structure between the channel and the back part of the printhead die; and an electrical connection extending between the back part of the printhead die and an electrical component, wherein the electrical connection is fully encapsulated in the monolithic molding.

9. The printhead of claim 8, wherein the electrical connection further comprises a bond wire that extends from a bond pad on the back part of the printhead to a bond pad on the electrical component.

10. The printhead of claim 8, wherein the front face forms an uninterrupted planar face.

11. A printhead, comprising:

an elongated cuboidal printhead die sliver in a monolithic molding covering a back part and sides of the die sliver leaving a front of the die sliver exposed along a planar surface that includes a front face of the die sliver and the monolithic molding surrounding and in physical contact with the front face of the die sliver and a portion of the back part of the die sliver, the monolithic molding having an opening therein through which fluid, when present, is to pass directly from the opening to the back part of the die sliver in the absence of an intervening structure between the opening and the back part of the die sliver; and an electrical connection extending between the back part of the printhead die and an electrical component, wherein the electrical connection is fully encapsulated in the monolithic molding.

12. The printhead of claim 11, wherein the elongated cuboidal printhead die sliver comprises multiple elongated cuboidal die slivers arranged end to end along the monolithic molding in a staggered configuration; and the opening comprises multiple openings each positioned at a back part of each of the multiple elongated cuboidal die slivers.

13. The printhead of claim 12, wherein each of the multiple elongated cuboidal die slivers comprises an electrical connection between the back part of the die sliver to the electrical component.

* * * * *